US007222759B2

(12) United States Patent
Bunn et al.

(10) Patent No.: US 7,222,759 B2
(45) Date of Patent: May 29, 2007

(54) BEVERAGE CONTAINER WITH ONE-WAY VALVE ASSEMBLY

(75) Inventors: Arthur H. Bunn, Springfield, IL (US); William Midden, Springfield, IL (US); Keith Nybakke, Minneapolis, MN (US)

(73) Assignee: Bunn-O-Matic Corporation, Springfield, IL (US)

( * ) Notice: Subject to any disclaimer, the term of this patent is extended or adjusted under 35 U.S.C. 154(b) by 466 days.

(21) Appl. No.: 10/774,089

(22) Filed: Feb. 6, 2004

(65) Prior Publication Data

US 2005/0029284 A1 Feb. 10, 2005

Related U.S. Application Data

(60) Provisional application No. 60/445,869, filed on Feb. 7, 2003.

(51) Int. Cl.
*A47G 19/14* (2006.01)

(52) U.S. Cl. ..... 222/465.1; 222/1; 222/475.1; 222/511; 222/518; 141/21; 141/350

(58) Field of Classification Search ..... 222/465.1, 222/508, 469–475, 475.1, 509, 511, 518, 222/512, 1; 141/348–350, 18, 21; 220/714–715
See application file for complete search history.

(56) References Cited

U.S. PATENT DOCUMENTS 1,529,246 A 3/1925 Fenn
4,390,108 A 6/1983 Knoll ..... 220/228
4,638,928 A 1/1987 Webster ..... 222/155
4,858,787 A 8/1989 Stone ..... 222/188
4,867,349 A 9/1989 Stone, Jr. ..... 222/188
5,037,015 A * 8/1991 Collins ..... 222/472
5,497,917 A * 3/1996 Krimmel et al. ..... 222/475.1
5,653,362 A * 8/1997 Patel ..... 222/156
6,216,754 B1 * 4/2001 Geroult et al. ..... 141/350
6,648,183 B2 * 11/2003 Nybakke ..... 222/472
6,805,266 B2 * 10/2004 Doron et al. ..... 222/475

* cited by examiner

*Primary Examiner*—Frederick C. Nicolas
(74) *Attorney, Agent, or Firm*—Barnes & Thornburg LLP

(57) ABSTRACT

Disclosed is a container for containing a beverage and a grommet for use with a container, and a method of retaining liquid in a container and preventing reverse flow out of the container. The container is of the type for retaining a quantity of beverage including at least one wall containing a cavity therein, a rim defining a mouth, and a lid extending at least partially over the mouth. A valve port is provided in the lid. A grommet is provided for retention in the valve port including a flange and structures for retaining the grommet in the valve port. The grommet defines an aperture extending therethrough which communicates with the valve port. The beverage is passed through the aperture and valve port for retention in the cavity of the container. A tongue extends from the grommet into the valve port for movably blocking a portion of the valve port. The tongue is movably displaced as beverage is dispensed into the container and is positioned over a portion of the valve port for preventing reverse flow of beverage from the container out through the valve port.

18 Claims, 10 Drawing Sheets

BEVERAGE CONTAINER WITH ONE-WAY VALVE ASSEMBLY

RELATED APPLICATIONS

This application claims priority from U.S. Provisional Application No. 60/445,869, filed Feb. 7, 2003.

BACKGROUND

Beverage containers for receiving beverage from a brewer or other source of beverage and for thereafter serving the beverage are known in the art. Such beverage containers typically include a vessel for receiving the beverage, a top opening for receiving the beverage from the source and into the vessel, a spout for dispensing the beverage from the vessel, and a handle for facilitating the dispensing of the beverage.

SUMMARY

The present disclosure relates to one or more of the following features, elements, or combinations thereof:

A beverage container for a brewer or other source of brewed or other beverage that includes a lid and a valve assembly associated with the lid. The lid includes valve structure defining a valve port and the valve assembly comprises the valve structure and a valve grommet received by the valve port. The valve assembly defines a passageway through which the beverage may pass, but prevents or reduces reverse passage of beverage, steam or heat therethrough.

The valve grommet includes a valve flange defining an aperture and a tongue extending from the valve flange adjacent the aperture. A gasket is included with the grommet integral with the flange, extending circumferentially from each side of the tongue for sealingly engaging the lid. The valve grommet may be constructed of a flexible material.

The lid also includes a top surface and a bottom surface, and the valve structure includes an accurate wall extending downwardly from the top surface, a base, a pair of ribs and a wall which further define the valve port. The base includes a curved portion defining a drain recess. The wall has an inverted L-shaped cross section extending up from the bottom surface and then onward to adjacent the top surface to define a lip. The lip and the ribs define a channel for receiving the tongue of the valve grommet. The ribs separate the channel from the valve port.

The lid is positioned on a vessel for storing the beverage, and the container may be positioned beneath the brewer or other source, such that beverage, produced or provided by the brewer or other source, passes through the aperture defined by the valve grommet and the valve port. The weight flow action and/or pressure of the beverage within the valve port causes the tongue of the valve grommet to flex, shutter or otherwise be displaced outward adjacent the drain recess, to an open position so that the brewed beverage can pass through the valve port and into the vessel. The lid may also define a recess, including a reservoir, to allow overflow beverage to accumulate if necessary as brewed beverage is supplied to the valve port.

Once the supply of beverage passes into the vessel, the tongue of the valve grommet flexes, shutters or is otherwise displaced back to a closed position to prevent beverage from passing back into the valve port. The beverage container can thereafter be used to distribute beverage.

Accordingly, the flexibility of the tongue enables the valve assembly to operate in a one-way manner such that it enables beverage to pass into the vessel but prevents beverage received by the vessel from passing outside the vessel. The flexibility of the valve grommet also enables it to be quickly and easily removed from the valve port by, for example, manually grasping, squeezing and removing the valve grommet, for cleaning.

The lid may also include an engaging arm to facilitate rotation of the lid relative to the vessel between open and closed or attaching positions. The lid may also define a dispensing recess positioned generally opposite the dispensing arm for dispensing of beverage from the vessel. The lid and the vessel may be configured to define a torturous dispensing passageway.

The present disclosure also may relate to one or more of the features, elements or combinations thereof described in the accompanying drawings described below or the Detailed Description of the Drawings set forth below.

Additional features will become apparent to those skilled in the art upon consideration of the following description exemplifying the best mode as presently perceived.

BRIEF DESCRIPTION OF DRAWINGS

The detailed description particularly refers to the accompanying figures in which.

DESCRIPTION OF THE DRAWINGS

Figure 1:
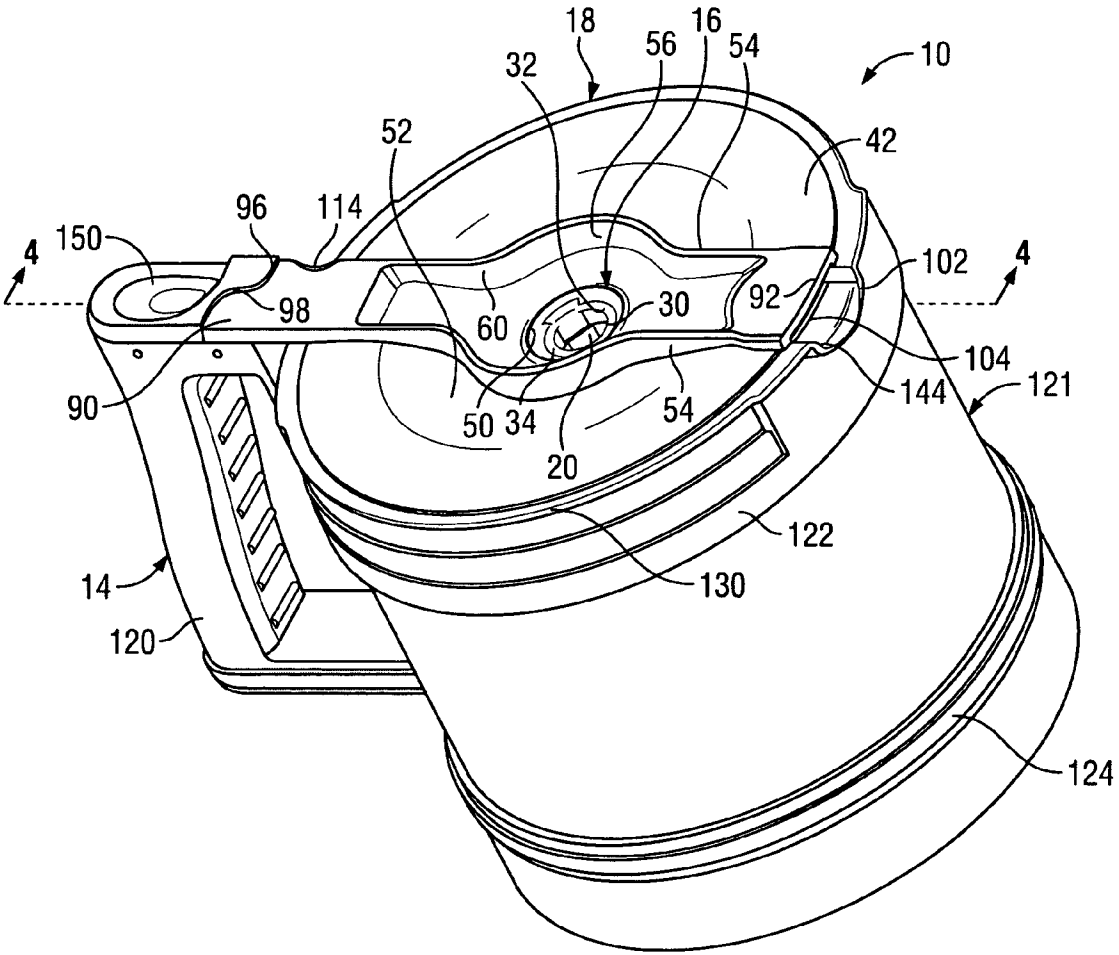
FIG. 1 is a perspective view of a thermal carafe in accordance with an embodiment of the description.

While the present disclosure may be susceptible to embodiment in different forms, there is shown in the drawings, and herein will be described in detail, at least one with the understanding that the present description is to be considered an exemplification of the principles of the disclosure and is not intended to limit the disclosure to the details of construction and the arrangements of components set forth in the following description or illustrated in the drawings.

Figure 2:
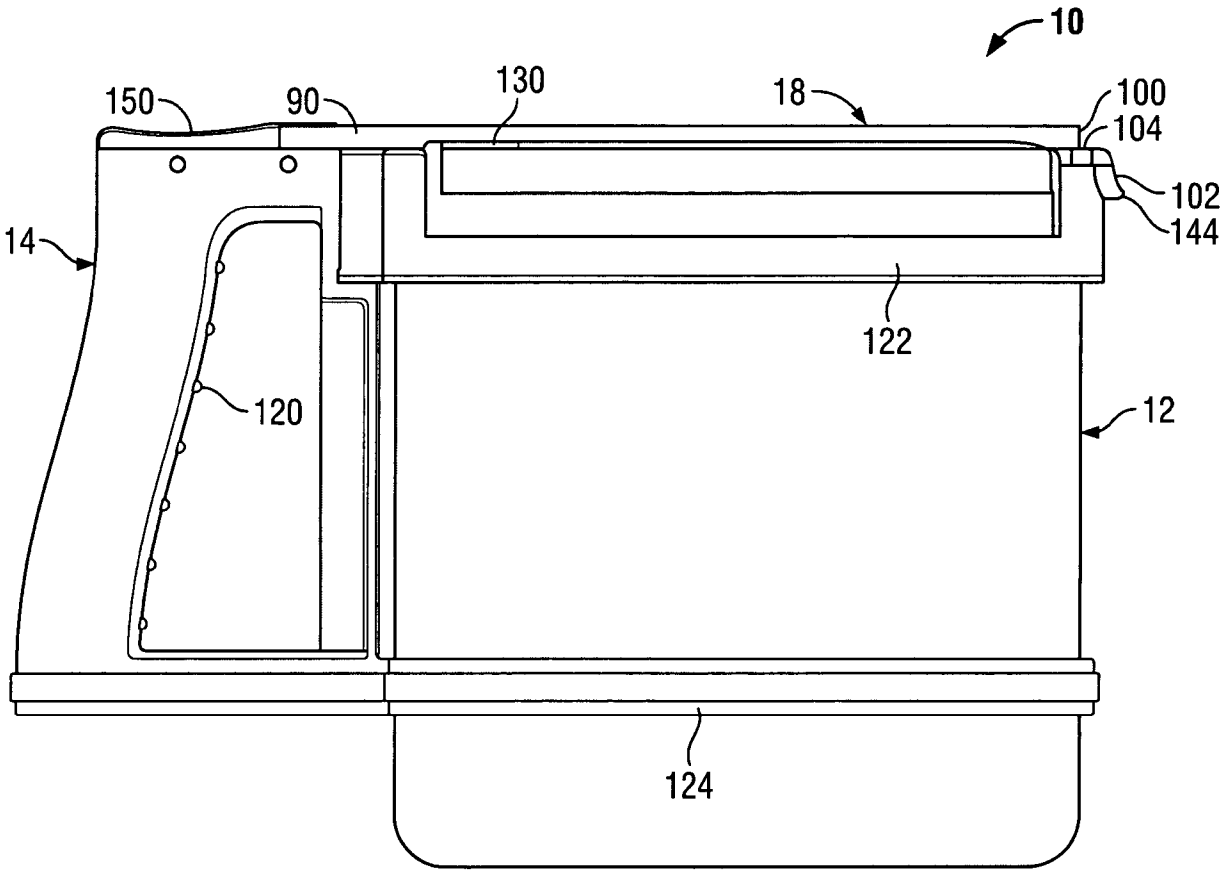
FIG. 2 is a side plan view of the thermal carafe of FIG. 1.
Figure 3:
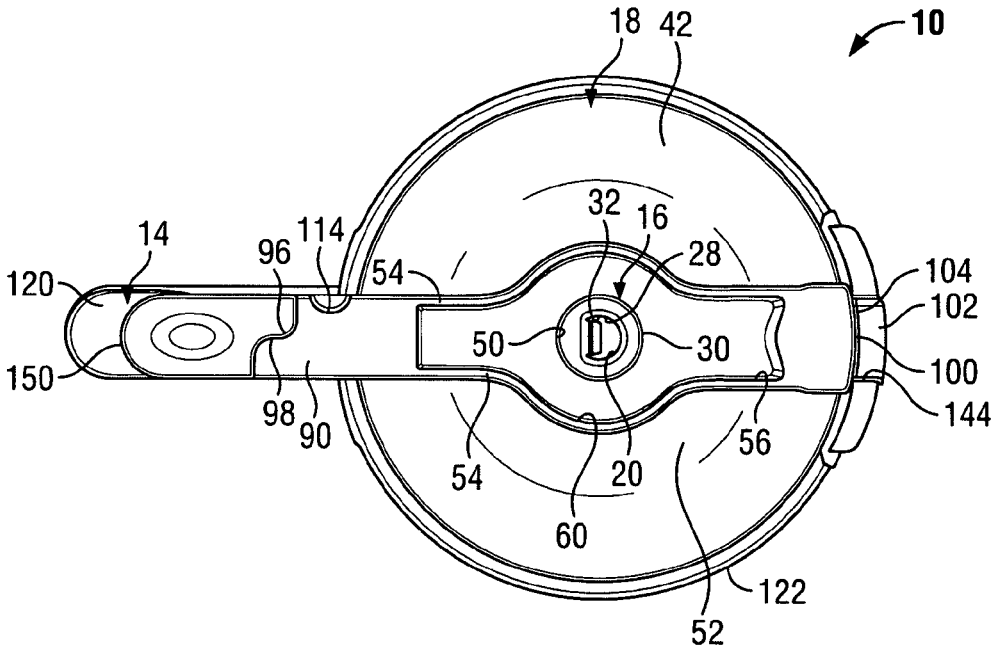
FIG. 3 is a top plan view of the thermal carafe of FIG. 1.
Figure 4:
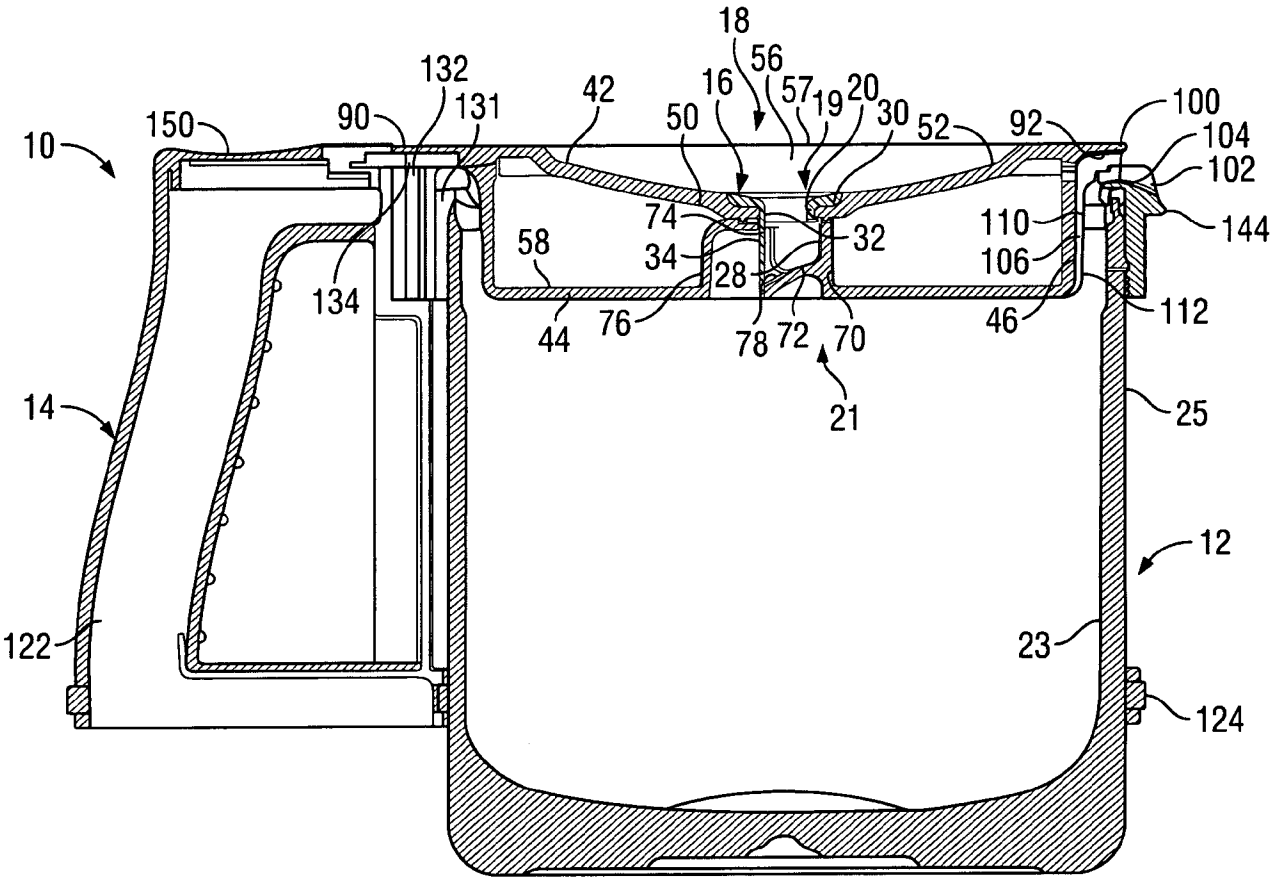
FIG. 4 is a cross section view taken along lines 4—4 of FIG. 1.
Figure 5:
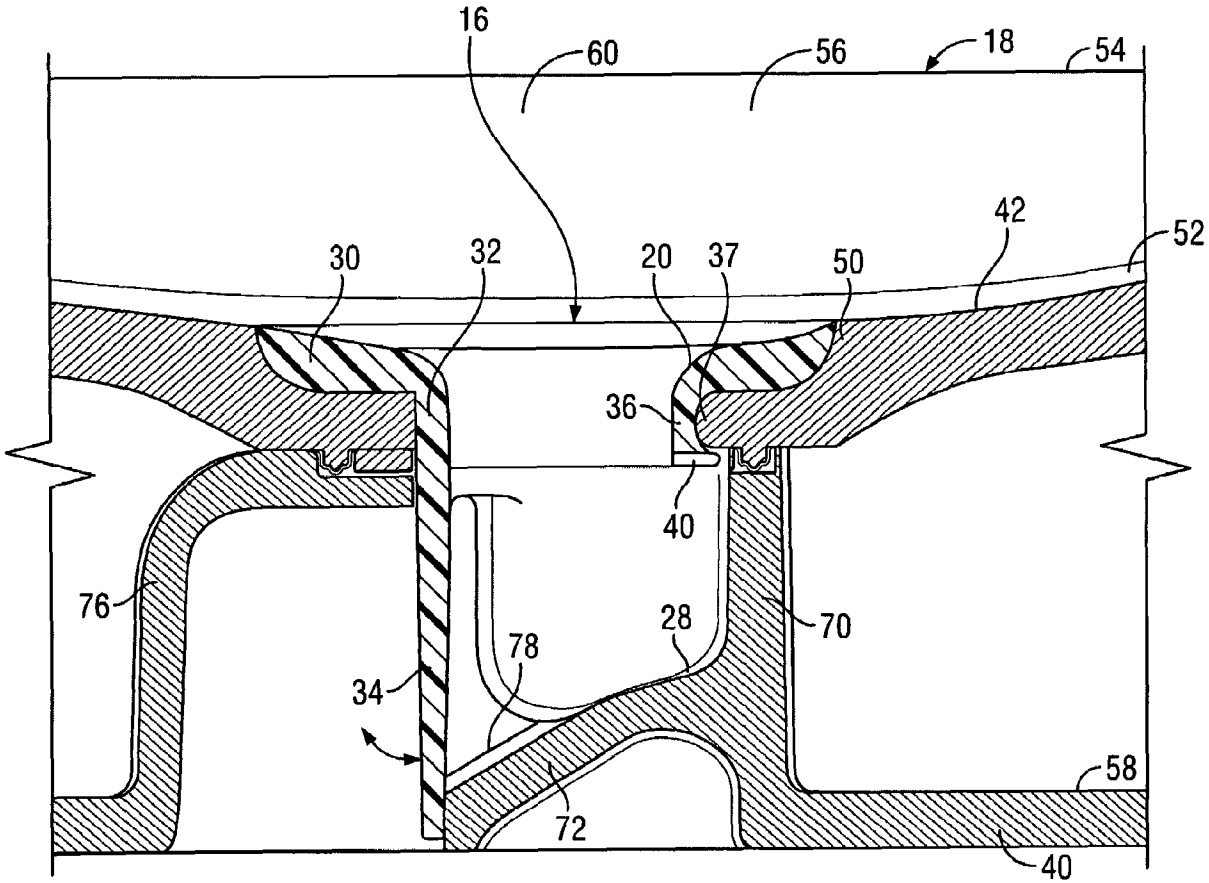
FIG. 5 is a partial fragmentary enlarged view of FIG. 4, illustrating the valve assembly of the carafe of FIG. 1.
Figure 6:
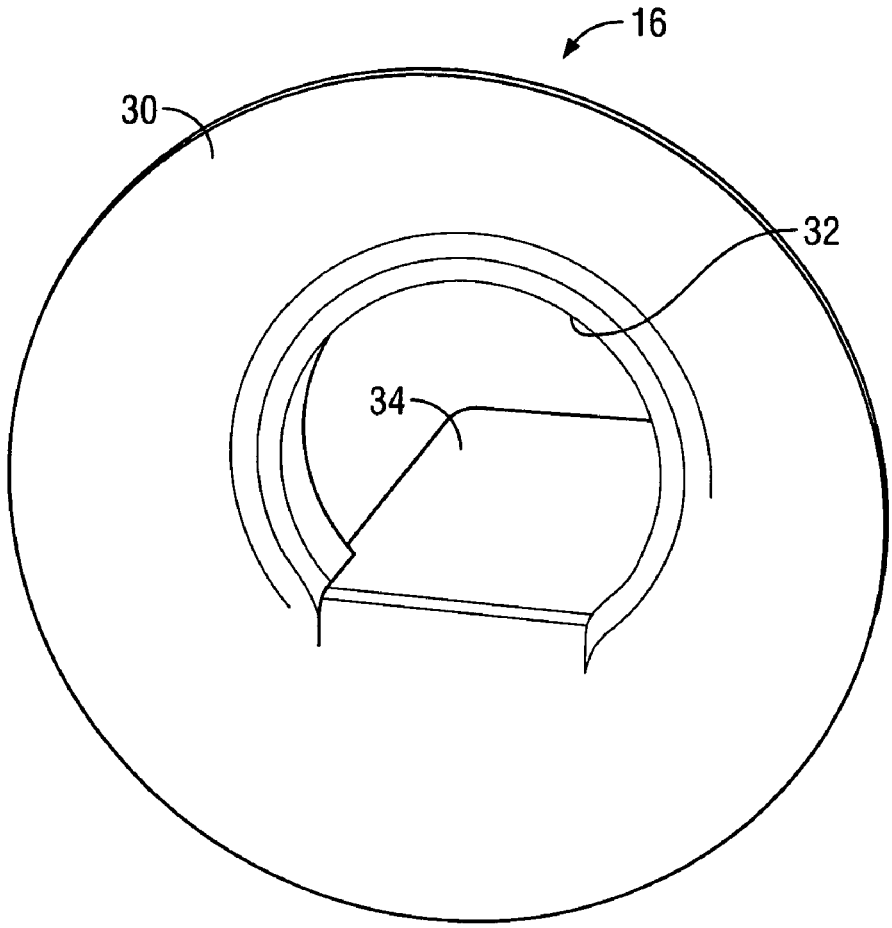
FIG. 6 is a top perspective view from the top of the valve grommet of the valve assembly of the carafe of FIG. 1.
Figure 7:
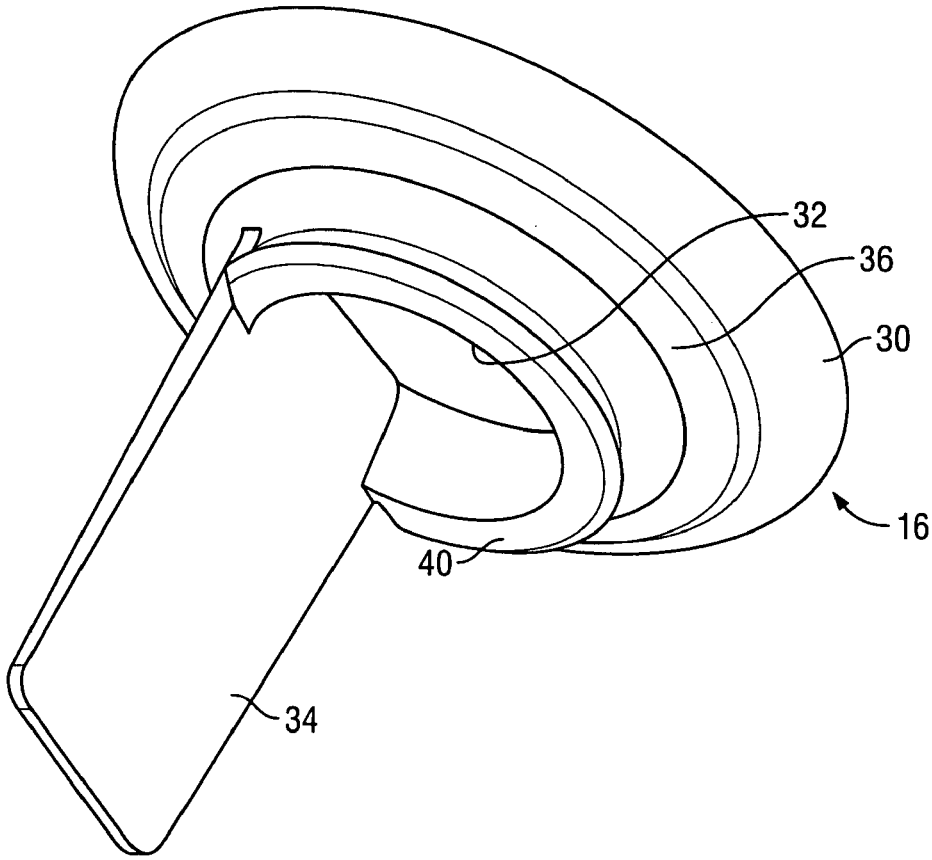
FIG. 7 is a bottom perspective view from the bottom of the valve grommet of the valve assembly of the carafe of FIG. 1.
Figure 8:
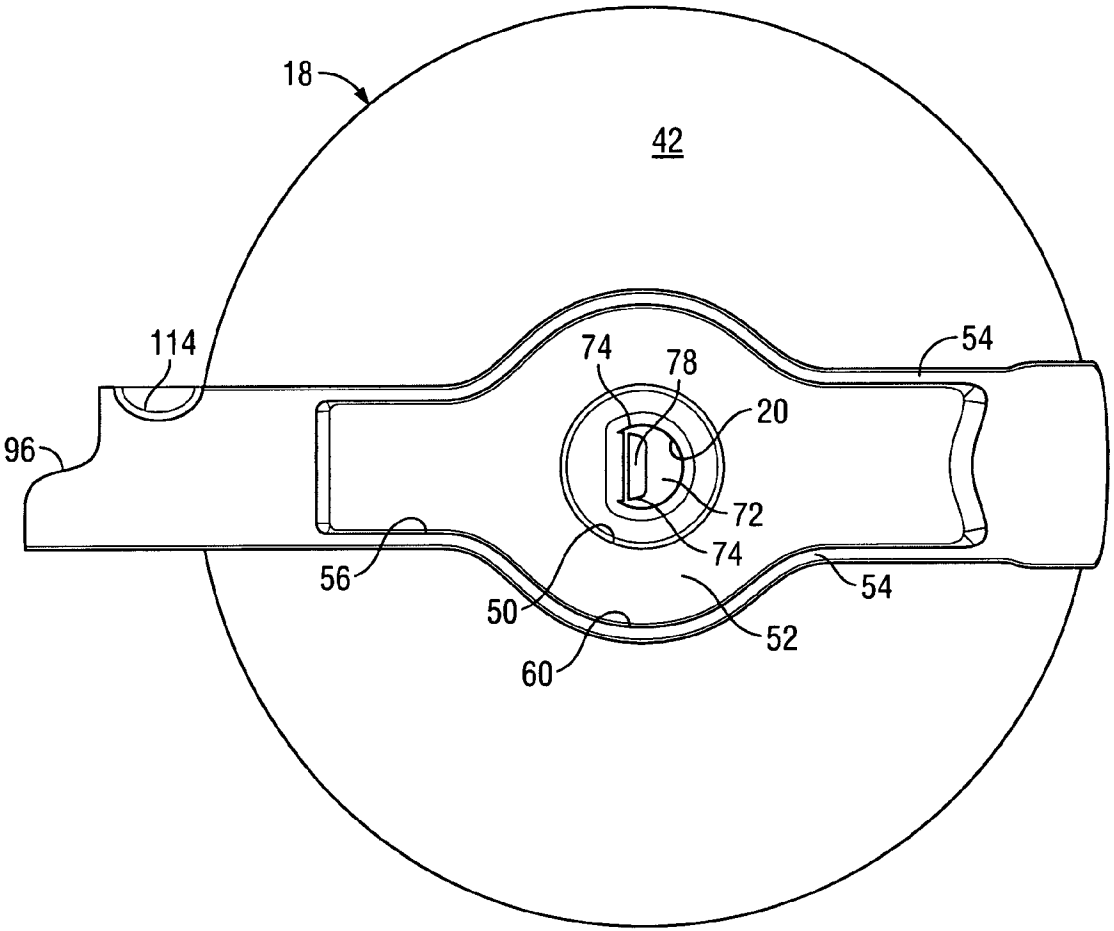
FIG. 8 is a top plan view of the cover of the carafe of FIG. 1 with the valve grommet removed.
Figure 9:
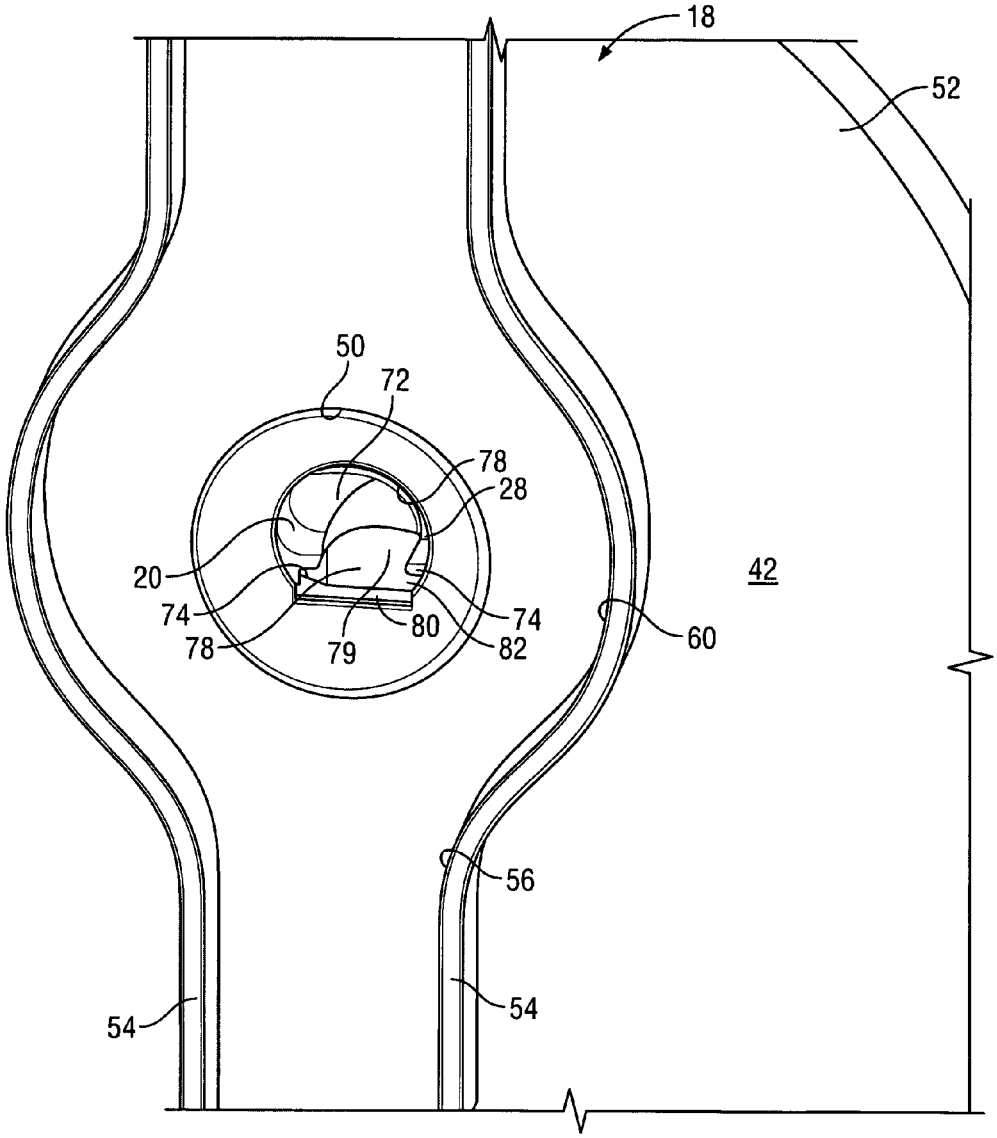
FIG. 9 is a partial and enlarged perspective view of the cover of the carafe of FIG. 1 with the valve grommet removed.
Figure 10:
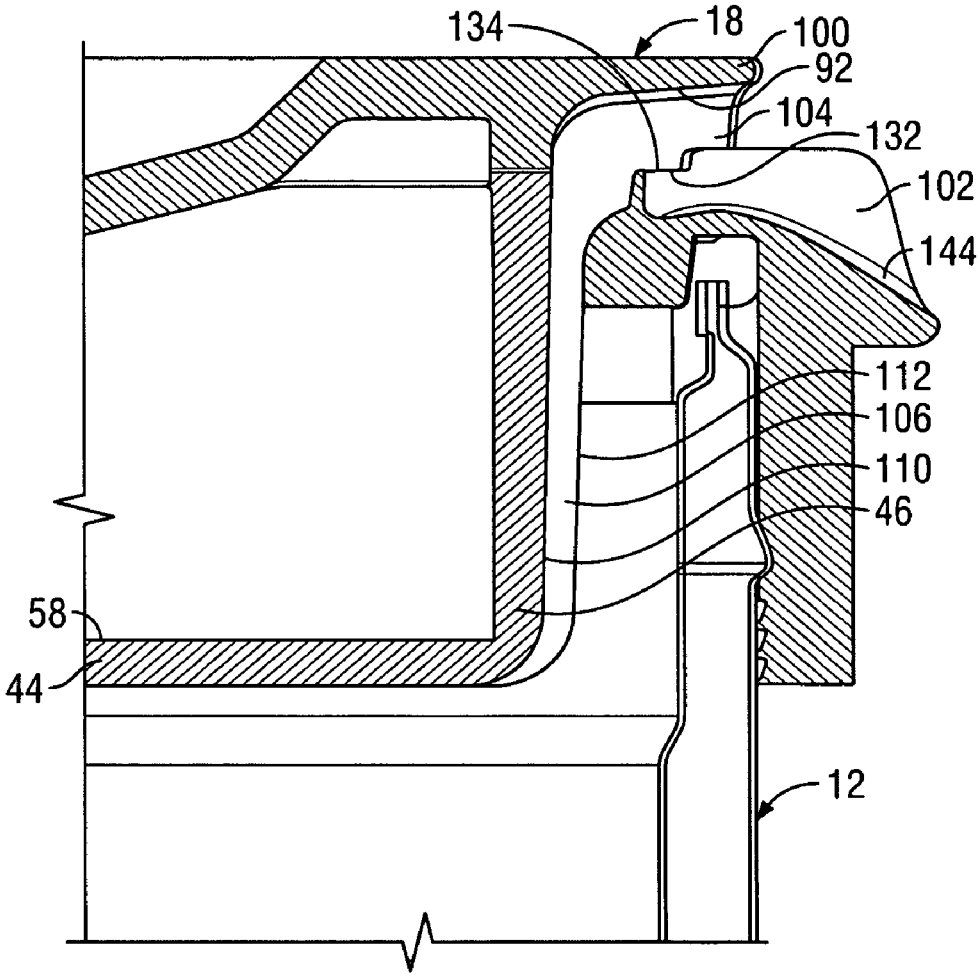
FIG. 10 is a partial and enlarged view of FIG. 4, illustrating the spout of the carafe of FIG. 1.

FIGS. 1–10 provide an illustrative embodiment of a beverage container in the form of a thermal carafe 10 for a brewer or other source of brewed or other beverage. The carafe 10 includes generally a vessel 12 for storing the brewed beverage, a handle assembly 14, a valve grommet 16, and a lid 18 including valve structure 19 defining a valve port 20. The thermal carafe 10 includes a one-way valve assembly 21, comprised generally of the valve grommet 16 and the valve structure defining the valve port 20. The valve assembly 21 provides a passageway 28 through which the beverage may pass into the a cavity 23 defined by a wall 25 of vessel 12, but prevents or minimizes reverse passage therethrough of brewed beverage received by the vessel 12.

The valve grommet 16 is received by the valve port 20, and includes a valve flange 30 defining an aperture 32 and a tongue 34 extending from the valve flange 30 adjacent the aperture 32. The bottom of the flange 30 may include an arcuate indentation or groove 36 for seating against a corresponding surface or protrusion 37 within the valve port 20. The valve grommet 16 also includes a gasket 40 integral with the flange 30, extending arcuately from each side of the tongue 34 for sealingly engaging the lid 18. The valve grommet 16 may be constructed of a flexible material such as any suitable elastomer or the like.

The lid 18 includes a top surface 42, a bottom surface 44 and a peripheral rim 46. The top surface 42 defines a recess 50 and includes a concave portion 52 and a pair of upwardly-extending walls 54 which define a reservoir 56 disposed about the recess. The upwardly-extending walls 54 are spaced apart from each other and extend generally parallel to each other, except that they include a center section in which the walls are generally at least partially arcuate to define an enlarged recess segment 60 that may be positioned directly under the source of the beverage. The recess 50 and reservoir 56 are configured to receive any overflow of brewed beverage passing through the passageway 28 of the valve assembly. The top surface 42, bottom surface 44 and the peripheral rim 44 define an annular internal space 58 that provides insulation benefits. The internal space 58 may include foam or any other insulation if desired.

The valve structure of the lid 18 includes a partially accurate wall 70 extending downwardly from the top surface 42, an extending base 72, a pair of ribs 74 and an opposing wall 76 which further define the valve port 20. The base 72 includes a curved portion defining a drain recess 78 and passage 79. The wall 76 has an inverted L-shaped cross section extending up from the bottom surface 40 and then extending toward the adjacent top surface 40 to define a lip 80. The lip 80 and the ribs 74 define a channel 82 for receiving the tongue 34 of the valve grommet 16. The ribs 74 separate the channel 82 from the valve port 20.

The carafe 10 may be positioned beneath the brewer or other source, and beverage brewed, produced or otherwise provided by the source, passes into the valve port 20. The brewed beverage passes through the aperture 32 defined by the valve grommet 16 and into the valve port 20. The weight of the beverage within the valve port 20 causes the tongue of the valve grommet 16 beginning adjacent the drain recess 78, to flex or shutter outward to an open position so that the brewed beverage can pass through the valve port 20 and through passage 28 and into the vessel 12. The reservoir 56, including the enlarged recess segment 60, allow overflow beverage to accumulate if necessary as beverage is supplied to the valve port 20.

Once a supply of the beverage passes into the vessel 12, the tongue 34 of the valve grommet 16 flexes or shutters back to a closed position to prevent beverage from passing back into the valve port 20. The carafe 10 can thereafter be used to distribute beverage, with the tongue 34 remaining in the closed position. Accordingly, the flexibility of the tongue 34 enables the valve assembly to operate in a one-way manner such that it enables brewed beverage to pass into the vessel 12 but prevents brewed beverage received by the vessel from passing outside the vessel. The flexibility of the valve grommet 16 also enables it to be quickly and easily removed from the valve port 20 by, for example, manually grasping, squeezing and removing the valve grommet 16, for cleaning.

The lid 18 also includes an engaging arm 90 to facilitate rotation of the lid relative to the vessel 12 between open and closed positions and defines a dispensing recess 92 diametrically opposite the engaging arm for dispensing of brewed beverage from the vessel 12. The engaging arm 90 includes a serpentine engaging face 96 to engage a mating serpentine engaging face 98 on the handle assembly 14. The engaging faces 96 and 98 enable the engaging arm 90 to be readily positioned in the open position. The dispensing recess 92 is defined by a lip 100 of the lid 18 which aligns adjacent a lip 102 on the handle assembly 14 to define a dispensing spout 104 on the handle assembly 14 and to open the dispensing spout to permit pouring of brewed beverage from the vessel 12. The lid 18 also includes a pair of spaced apart guide walls 106 which extend upward along the rim 46 and lead into the lip 100 to define a torturous dispensing passageway 110.

Accordingly, when the engaging faces 96 and 98 of the engaging arm 90 and the handle assembly 14 are engaged, the engaging arm aligns with the handle assembly 14 such that the handle assembly can be manually held to pour beverage through the spout 104. When the carafe 10 is tilted for pouring, beverage passes through the dispensing passageway 110 and through the dispensing spout 104. To close the spout 104, the engaging arm 90 is rotated, which causes the dispensing recess 92 to rotate relative to the spout and causes the rim of the lid 18 to close the spout. The engaging arm 90 defines a curved recess 114 to provide a grip to facilitate rotation of the engaging arm.

The vessel 12 and handle assembly 14 may have any suitable configuration and may be constructed of any suitable material. In the illustrated embodiment, for example, the vessel 12 is cylindrical and defines a cavity for storing the beverage. The handle assembly 14 includes a handle portion 120, an upper ring 122 disposed about an upper portion of the vessel 12, and a lower ring disposed about a lower portion of the vessel 12. The handle assembly 14 may be constructed in any suitable manner. For example, the upper ring 122 may be assembled with the handle portion 120, and the lower portion 124 may be unitary with the handle portion. The upper ring 122 includes a top rim 130 defining a mouth 131 and a lip 132, which extend substantially circumferentially to define a substantially circumferential recess 134 for receiving the outer rim of the lid 18, with the rim resting on the lip. The lip 102 of the upper ring 122 also defines a pour spout 144 for dispensing the brewed beverage. The handle portion 120 defines a recess 150 to provide a thumb grip.

Terms including brewed, brewing, brewing substance, brewing liquid, beverage, and brewed beverage as used herein are intended to be broadly defined as including but not limited to the brewing of coffee, tea and any other brewed beverage. This broad interpretation is also intended to include, but is not limited to any process of dispensing, infusing, steeping, reconstituting, diluting, dissolving, saturating or passing a liquid through or otherwise mixing or combining a beverage substance with a liquid such as water without a limitation to the temperature of such liquid unless specified. This broad interpretation is also intended to include, but is not limited to beverage substances such as ground coffee, tea, liquid beverage concentrate, powdered beverage concentrate, freeze dried coffee or other beverage concentrates, to obtain a desired beverage or other food.

The embodiment set forth in this description is not intended in any way to limit the scope of the present application and appended claims. The embodiment is intended to be expansive and broadly interpreted without limitation. Various features of the disclosed invention have been particularly shown and described in connection with the disclosure as shown and described, however, it must be understood that these particular arrangements and methods merely illustrate, and that the disclosure is to be given its fullest interpretation within the terms of the appended claims.

We claim:

1. A beverage container for retaining a volume of beverage, the beverage container comprising:

a wall defining a cavity in which the beverage is contained;

a rim defined along an upper edge of the wall the rim defining a mouth;

a lid at least partially extending over the mouth;

valve structure on the lid defining a valve port extending through the lid for communicating with the cavity of the container;

a valve grommet positionable in the valve port, the grommet defining an aperture communicating with the valve port for facilitating flow of the beverage through the aperture and valve port into the cavity; and a tongue extending from the grommet downwardly from a top surface of the lid towards a bottom of the container and at least partially extending into the valve port and movable relative to the valve port for facilitating flow of the beverage into the cavity and resisting reverse passage of the beverage therethrough.

2. The beverage container according to claim 1 further comprising:

the valve port communicating with a passage extending through the lid opening, the passageway defining an opening, the tongue extending over at least a portion of the opening.

3. The beverage container according to claim 1, the grommet further comprising a flange extending around the grommet for engaging the valve port.

4. The beverage container according to claim 3, the grommet further comprising a groove at least partially extending around an outer portion of the flange, the valve port including a correspondingly shaped structure for engaging the groove.

5. The beverage container according to claim 3, the grommet further comprising a generally circular shape defining a flange extending generally radially outwardly of the grommet, a generally arcuate indentation or groove being positioned around an outer perimeter of the flange and a corresponding protrusion upon the valve port for engaging the indentation on the flange to facilitate retention of the grommet in the port.

6. The beverage container according to claim 3, the grommet further comprising the tongue extending generally coaxial with the aperture in the grommet.

7. The beverage container according to claim 6, the tongue being at least partially formed of a flexible material for blocking movement relative to the flange of the grommet for movement relative to the passage in the lid.

8. The beverage container according to claim 3, the grommet being formed of a flexible material for flexible engagement with the valve port in the lid and for flexible disengagement therefrom to facilitate sealing of the valve port and removal and replacement to facilitate cleaning of the lid.

9. The beverage container according to claim 1, the lid further comprising a recess spaced around the valve port for facilitating flow of the beverage into the valve assembly.

10. The beverage container according to claim 1, the lid further comprising a reservoir disposed about the valve port for facilitating accumulation and retention of a volume of liquid to prevent overflowing of the lid.

11. The beverage container according to claim 1, the lid further comprising a reservoir disposed about the valve port for retaining a volume of liquid, the reservoir being defined by at least one wall generally extending upwardly from the top surface of the lid, the reservoir being oriented for flow of liquid into the reservoir and into the valve assembly.

12. A grommet for use with a beverage container, the beverage container being of the type defining a cavity and having a lid at least partially overlying the cavity, the lid defining a valve port extending therethrough, the grommet further comprising:

a flange;

the flange defining an aperture for communicating with a valve port for facilitating flow of beverage through the aperture and valve port into the cavity; and a tongue extending from the grommet downwardly from a top surface of the lid towards a bottom of the container and at least partially extending into the valve port and movable relative to the valve port for facilitating flow of the beverage into the cavity and resisting reverse passage of the beverage therethrough.

13. The beverage container according to claim 12, the grommet further comprising a groove at least partially extending around an outer portion of the flange, the valve port including a correspondingly shaped structure for engaging the groove.

14. The grommet according to claim 12, the grommet further comprising a generally circular shape defining the flange extending generally radially outwardly of the grommet, a generally arcuate indentation or groove being positioned around an outer perimeter of the flange and a corresponding protrusion upon the valve port for engaging the indentation on the flange to facilitate retention of the grommet in the port.

15. The grommet according to claim 12, the grommet further comprising the tongue extending generally coaxial with the aperture in the grommet.

16. The grommet according to claim 15, the tongue being at least partially formed of a flexible material for movement relative to the flange of the grommet for movement relative to the passage.

17. The grommet according to claim 12, the grommet being formed of a flexible material for flexible engagement with valve port in a lid and for flexible disengagement therefrom to facilitate sealing of the valve port and removal and replacement to facilitate cleaning of a lid.

18. A method of receiving liquid into and retaining the liquid in a beverage container, the method comprising the steps of:

providing the beverage container having a wall defining a cavity in which the liquid is contained, a rim defined along the upper edge of the wall and defining a mouth, a lid at least partially extending over the mouth, a mouth structure on the lid defining a valve port extending through the lid for communicating with the cavity of the container, a valve grommet received in the valve port, the grommet defining an aperture communicating with the valve port for facilitating flow of the liquid through the aperture and valve port into the cavity, a tongue extending downwardly from a top surface of the lid towards a bottom of the container and extending from the grommet at least partially into the valve port and movable relative to the valve port for facilitating flow of the liquid into the cavity and resisting reverse passage of the liquid therethrough;

dispensing the liquid into the container through the aperture and valve port;

displacing the tongue by movement of the liquid through the aperture in valve port into the cavity of the container;

ceasing dispensing of the liquid into the container; and flexibly returning the tongue to a position overlying at least a portion of the valve port for preventing reverse flow of the liquid from the container through the valve port.

* * * * *